US009220390B2

(12) United States Patent
Ali et al.

(10) Patent No.: US 9,220,390 B2
(45) Date of Patent: Dec. 29, 2015

(54) CLEANING DEVICE WITH CLEANING PAD

(76) Inventors: Peter Kalam Ali, London (GB); Russell Peter Yates, London (GB); Francis Edzard Yates, London (GB)

( * ) Notice: Subject to any disclaimer, the term of this patent is extended or adjusted under 35 U.S.C. 154(b) by 563 days.

(21) Appl. No.: 13/261,436

(22) PCT Filed: Apr. 6, 2011

(86) PCT No.: PCT/GB2011/000530
§ 371 (c)(1),
(2), (4) Date: Sep. 19, 2012

(87) PCT Pub. No.: WO2011/128617
PCT Pub. Date: Oct. 20, 2011

(65) Prior Publication Data

US 2013/0014334 A1 Jan. 17, 2013

(30) Foreign Application Priority Data

Apr. 12, 2010 (GB) ..... 1006071.3

(51) Int. Cl.
*A47L 13/146* (2006.01)

(52) U.S. Cl.
CPC ..... *A47L 13/146* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 2,251,384 | A * | 8/1941 | Thomas | 15/119.1 |
| 2,916,754 | A * | 12/1959 | Zottola | 15/116.2 |
| 3,006,010 | A * | 10/1961 | O'Rorke | 15/119.2 |
| 4,516,287 | A * | 5/1985 | Johnson et al. | 15/119.2 |
| 6,394,683 | B1 * | 5/2002 | Pao | 401/289 |
| 6,540,424 | B1 | 4/2003 | Hall et al. | |
| 2005/0028309 | A1 * | 2/2005 | Boyer et al. | 15/119.2 |
| 2010/0313369 | A1 * | 12/2010 | Lin | 15/119.2 |

FOREIGN PATENT DOCUMENTS

| | | | |
|---|---|---|---|
| DE | 10 2007 057602 | A1 | 6/2009 |
| EP | 0 494 021 | A1 | 7/1992 |
| EP | 1 472 965 | A1 | 11/2004 |
| WO | WO 2004/054424 | A1 | 7/2004 |

* cited by examiner

*Primary Examiner* — David Walczak
(74) *Attorney, Agent, or Firm* — Iandiorio Teska & Coleman, LLP

(57) ABSTRACT

A cleaning device (2) comprising a first support member (6), a second support member (8), a cleaning pad (10) which is supported by the first and second support members (6, 8) and which is made of a liquid-absorbing material, a lever mechanism (34) for the first and second support members (6, 8), a drying aperture (32), and a handle (44), and the cleaning device (2) being such that: (i) the first and second support members (6, 8) are pivotable towards each other; and (ii) pulling on the lever mechanism (34) causes the first and second support members (6, 8) to pivot towards each other and be pulled into the drying aperture (32) in the cleaning device (2).

15 Claims, 15 Drawing Sheets

20
18
10
14
16
12

20
18
10a
66
14
16
12

50b
53
51
53
55

20
18
66
10a 20
18
66a
10a 20
18
66b
10b

CLEANING DEVICE WITH CLEANING PAD

This invention relates to a cleaning device and, more especially, this invention relates to a cleaning device with a cleaning pad.

There are many different types of cleaning devices for cleaning surfaces such for example as work surfaces, table tops, floors and inside containers. The known cleaning devices often include a pad which is able to absorb liquid from a surface being cleaned. The cleaning pad is usually not easily squeezed in order to remove the liquid in an efficient and hygienic manner.

It is an aim of the present invention to reduce the above mentioned problem.

Accordingly, the present invention provides a cleaning device comprising a first support member, a second support member, a cleaning pad which is supported by the first and second support members and which is made of a liquid-absorbing material, a lever mechanism for the first and second support members, a frame portion, a drying aperture which is in the frame portion and which is defined by four sides of the frame portion, and a handle, and the cleaning device being such that:

(i) the first and second support members are pivotable towards each other;

(ii) pulling on the lever mechanism causes the first and second support members to pivot towards each other and be pulled into the drying aperture in the cleaning device;

(iii) the first and second support members are pulled into the drying aperture in a direction which is offset from a longitudinal axis of the handle; and (iv) the pulling of the first and second support members into the drying aperture causes sides of the drying aperture to exert a pressure on the first and second support members such that the first and second support members squeeze the cleaning pad so that liquid is able to be removed from the cleaning pad.

The cleaning device of the present invention is advantageous in that the first and second support members are able to squeeze the pad in an efficient and hygienic manner as they are pulled through the drying aperture in the cleaning device. The first and the second members are able to extend over the entire surface of the cleaning pad and thus transmit squeezing pressure over the entire cleaning pad. Still further, the squeezing of the cleaning pad is able to be effected through the first and second support members and thus there is no need for a person's hands to actually contact the cleaning pad and become wet from the liquid in the pad. This is especially advantageous if the liquid in the pad is dirty, or is likely to cause a stain on the person's hands, or is likely to be contaminated with an infectious substance. The cleaning device may be made in different sizes for cleaning a wide variety of surfaces including floor surfaces, wall surfaces, ceiling surfaces, work surfaces, table tops, inside containers including cups and glasses, and contoured surfaces such as car bodies. A wet surface is quickly able to be dried because the cleaning pad is easily squeezed to remove water transferred to the cleaning pad.

The lever mechanism may pivot about the handle. Alternatively, the lever mechanism may pivot about a frame portion located between the handle and the first and second support members.

Advantageously, the lever mechanism has an extendable portion for increasing the length of the lever mechanism and thereby making it easier to pivot the lever mechanism and pull the first and second support members through the drying aperture. If desired however the lever mechanism may be a fixed length lever mechanism.

The drying aperture may be a rectilinear drying aperture. The rectilinear drying aperture is preferably a rectangular aperture but it may be a square aperture if desired. The drying aperture may be an open aperture, in which case the first and second support members may be pulled into and through the drying aperture. Alternatively, the drying aperture may be a mouth of a concave formation, in which case the first and second apertures are pulled into the concave formation. The concave formation may be a dome.

The handle may extend at a fixed angle with respect to the cleaning pad. Alternatively, the handle may be pivotable such that it is able to extend at different angles with respect to the cleaning pad. Such a pivotable handle may be advantageous in enabling users to achieve an optimum use angle of the handle with respect to the cleaning pad. Also, such a handle may be advantageous in enabling persons to clean more effectively surfaces under beds, cabinets and the like where a long handle may be required, with the handle needing to be at a much shallower angle with respect to the cleaning pad than is the case if a surface such for example as a floor is being cleaned by a person in an upright position.

The cleaning pad will usually be a rectangular cleaning pad.

The cleaning pad may be made of a sponge material. Other types of material may be employed so that, for example, the cleaning pad may be made of a cellulose-based material. Where the cleaning pad is made of a sponge material, then the sponge material may be a natural or synthetic sponge material. The sponge material may be an open cell or a closed cell sponge material. The sponge material may be, for example, polyvinyl alcohol sponge or polyurethane sponge. The cleaning pad may be made of a sponge material layer and an abrasive cleaning material layer. The sponge layer may be perforated with apertures.

If desired, the cleaning pad may include a auxiliary cleaning portion which is made of a different material to the remainder of the cleaning portion. In this case, the auxiliary cleaning portion may be made of a material which is more abrasive than the material of the remainder of the cleaning pad. The auxiliary cleaning portion can be used to give greater cleaning effect to dirty surfaces requiring more than just a cleaning wipe. The auxiliary portion may be a replaceable auxiliary portion. Alternatively, the auxiliary cleaning portion may be non-replaceable.

The cleaning pad may be a replaceable cleaning pad. Thus, when the cleaning pad becomes worn or clogged, it can be replaced with a new cleaning pad. Alternatively, the cleaning pad may be a non-replaceable cleaning pad. With a non-replaceable cleaning pad, then the entire cleaning device of the present invention will need to be replaced when the cleaning pad becomes worn. With a replaceable cleaning pad, any suitable and appropriate releasable fastener means can be employed for releasably fastening the replaceable cleaning pad in position. Thus, for example, the releasable fastener means may be clips, or matrices of interlocking plastics material such as that sold under the Registered Trade Mark Velcro.

A polishing cover, for example made of synthetic material, micro fibre or natural cotton material, may slip over the cleaning pad and support members and attached, for example by elasticated means. The cover may be inner lined with a moisture resistant membrane so that moisture from the damp sponge is not transferred to the polishing cover/cloth. The polishing cover can be attached over the cleaning pad by elasticated or other means.

The cleaning device may be one to which attachments such as a cleaning brush or squeegee can be facilitated.

The cleaning device may be such that two of the cleaning devices may be coupled pivotally together. To this end, the cleaning device may include coupling means.

The handle may be of a length constructed for enabling the cleaning device to be held in one hand during normal use. Alternatively, the handle may be of a length constructed for enabling the cleaning device to be held in two hands during normal use.

The handle may be a fixed length handle. Alternatively, the handle may be a telescopic handle. The telescopic handle may be employed for giving the cleaning device of the present invention greater length for cleaning inaccessible surfaces such for example as high surfaces, or under beds or wardrobes.

The device may include a chamber for receiving a cleaning liquid. The chamber may be positioned in the handle of the cleaning device. Alternatively, the chamber may be positioned in a cleaning head part of the cleaning device.

The chamber may include inlet means for enabling the cleaning liquid to be inserted into the chamber.

The cleaning device of the present invention may advantageously include dispensing means for dispensing the cleaning liquid from the chamber to the cleaning pad or surface to be cleaned. The dispensing means may include a conduit for conducting the cleaning liquid from the chamber to the cleaning pad or surface to be cleaned.

The dispensing means may include a hand-operated pump. As an alternative to using a hand-operated pump, the chamber may have a flexible portion which is squeezed in order to provide dispensing pressure for dispensing the cleaning liquid.

Alternatively, the handle can receive a cassette filled with cleaning fluids. The cassette may be pierced by a hollow spike leading from the inlet chamber of the dispensing pump. This allows liquid flow from the cassette into the inlet chamber.

The cleaning device may be one in which a polishing cloth cover can be attached over the cleaning pad, for example by elasticated or other means.

The cleaning device may be one having means for receiving attachments such for example as a cleaning brush or a squeegee.

The cleaning device may be one having a formation enabling two of the cleaning devices to be coupled pivotally together.

Embodiments of the invention will now be described solely by way of example and with reference to the accompanying drawings in which.

Figures 4, 4A, 4B, 4C, 4D, 4E:
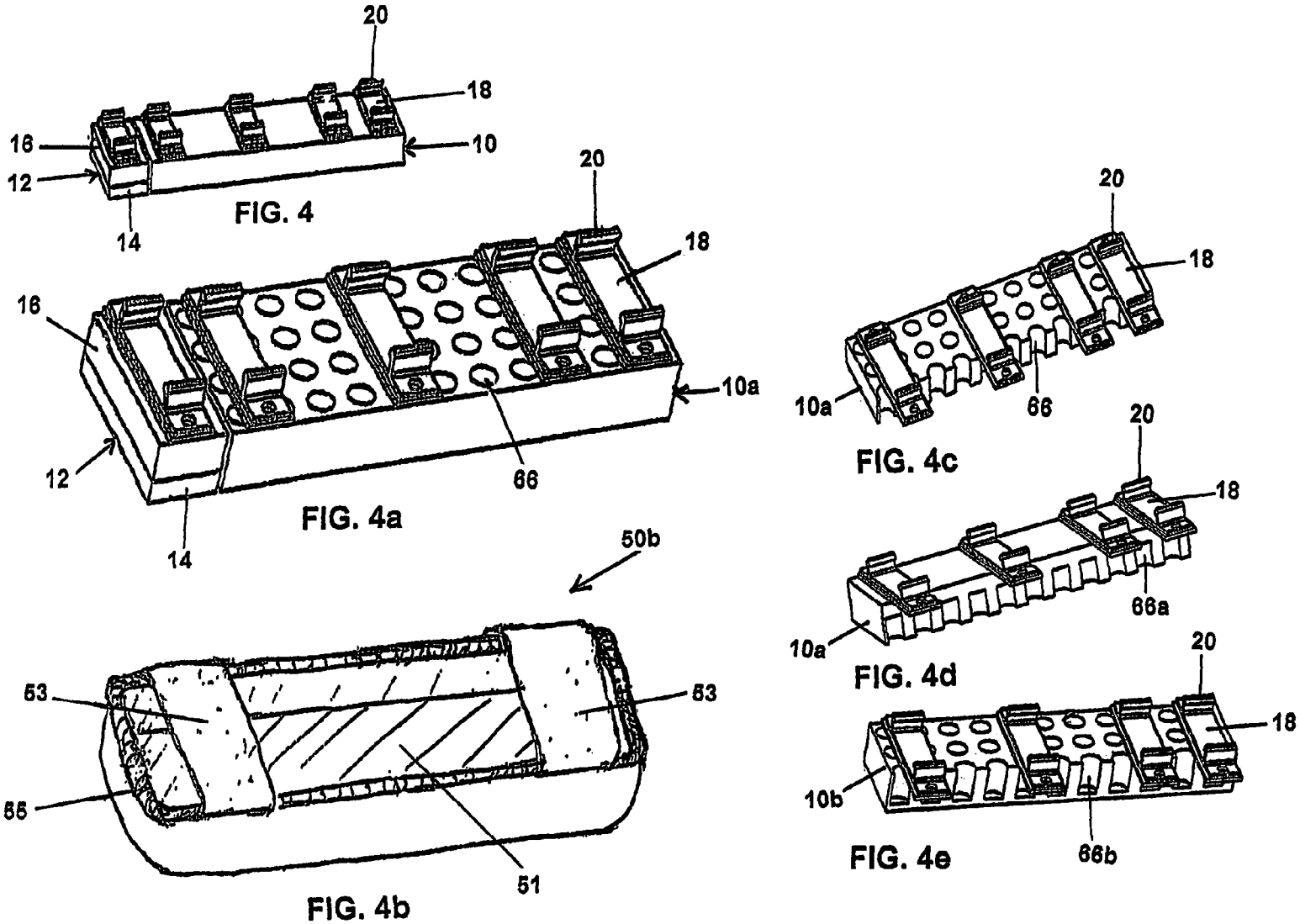
FIG. 4 is a perspective view of a replaceable cleaning pad used in the device shown in FIGS. 1-3.

FIG. 4*a* is a perspective view of an alternative replaceable cleaning pad;

FIG. 4*b* is a perspective view of an alternative replaceable cleaning pad;

FIG. 4*c* is a section through the replaceable cleaning pad shown in FIG. 4*a;*

Figure 1:
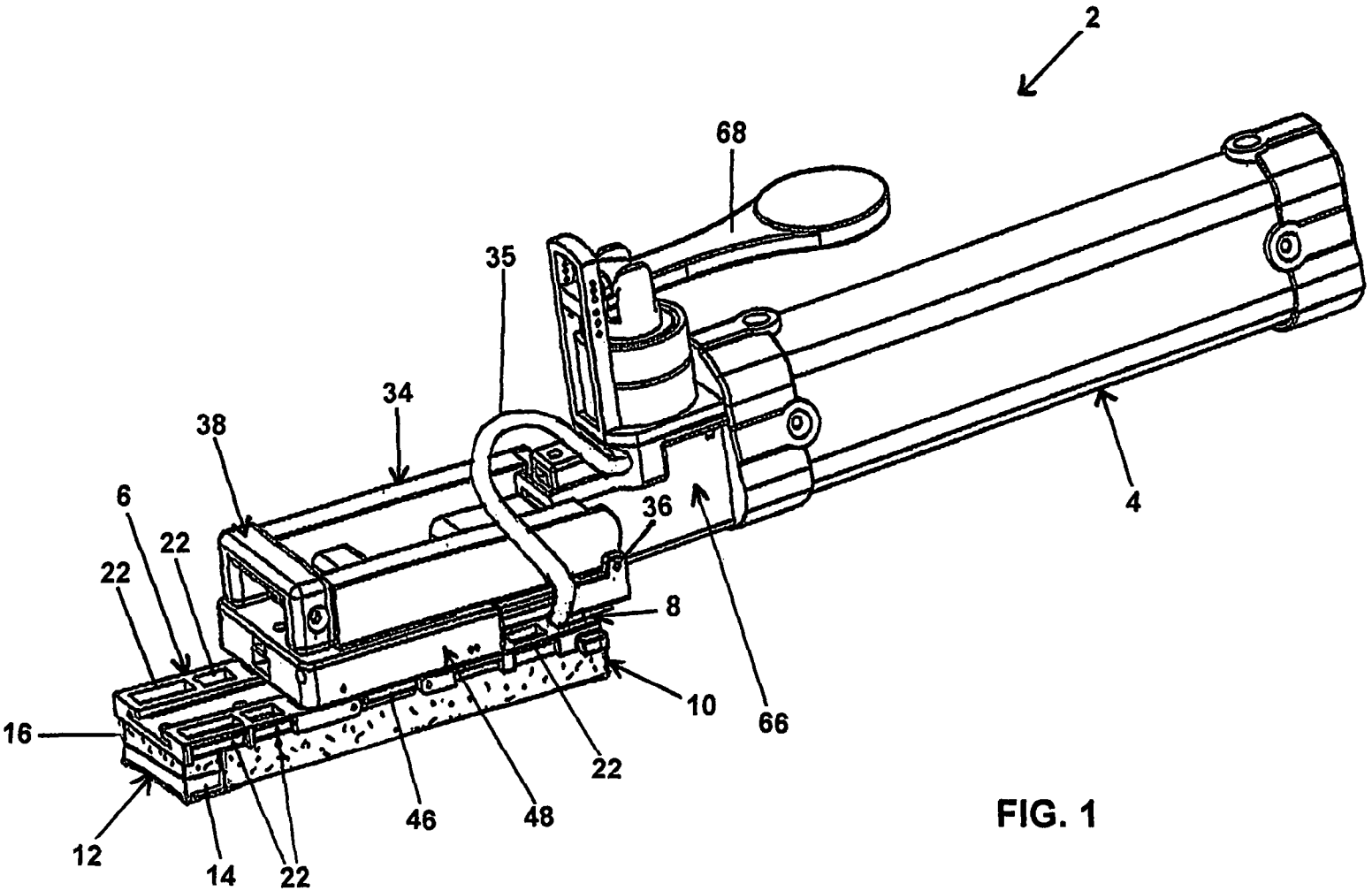
FIG. 1 is a perspective view of a first hand-held cleaning device of the present invention.
Figure 5:
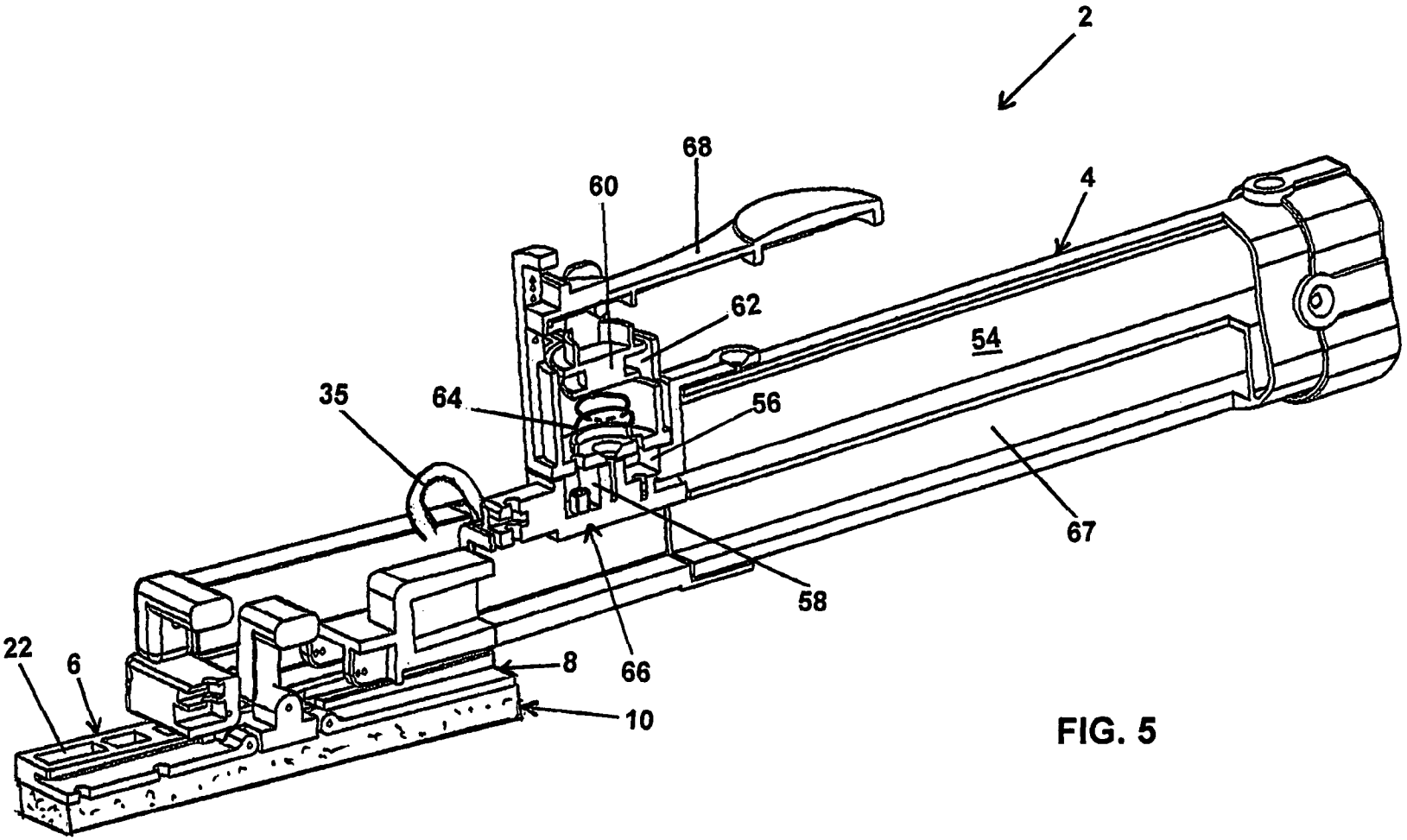
Figure 6:
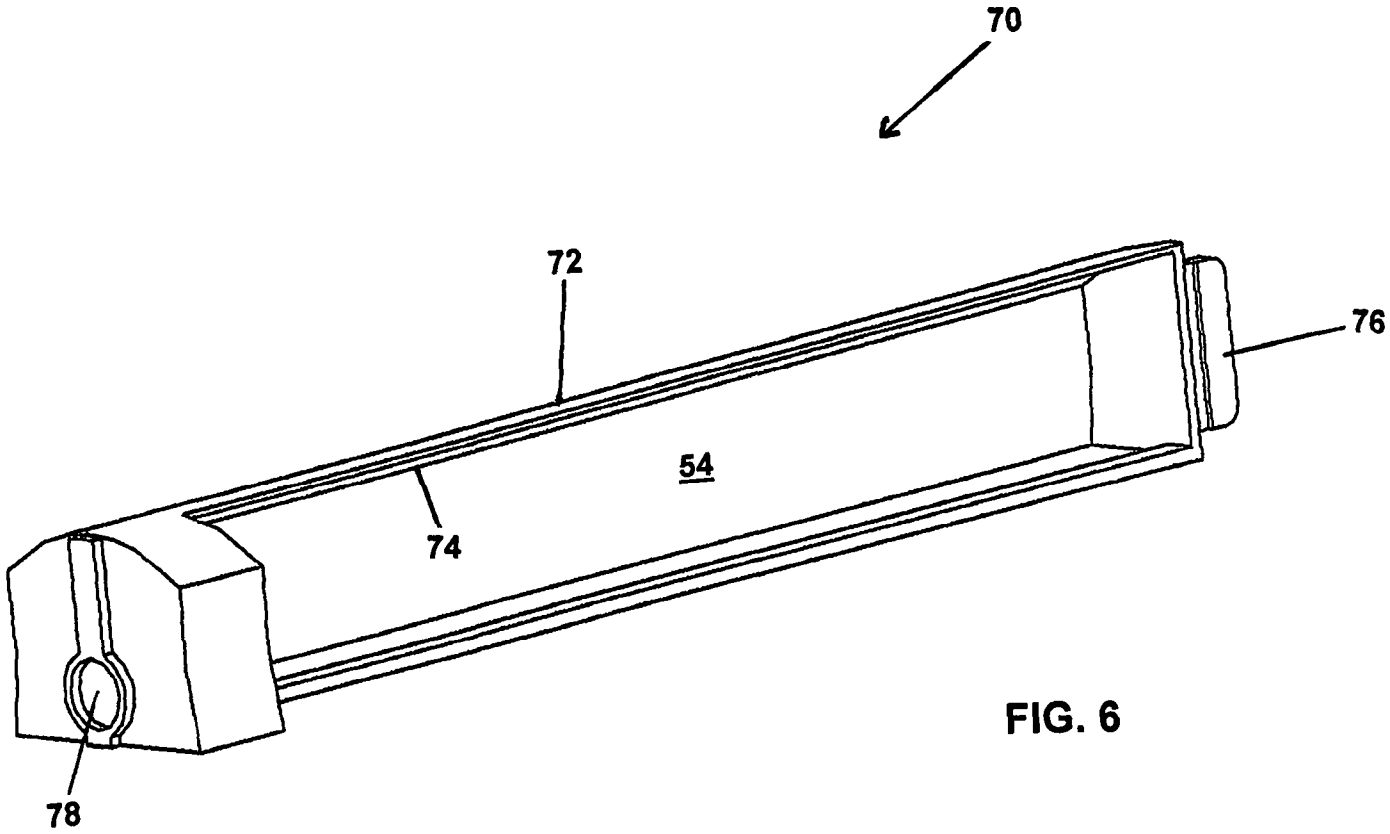
Figure 7:
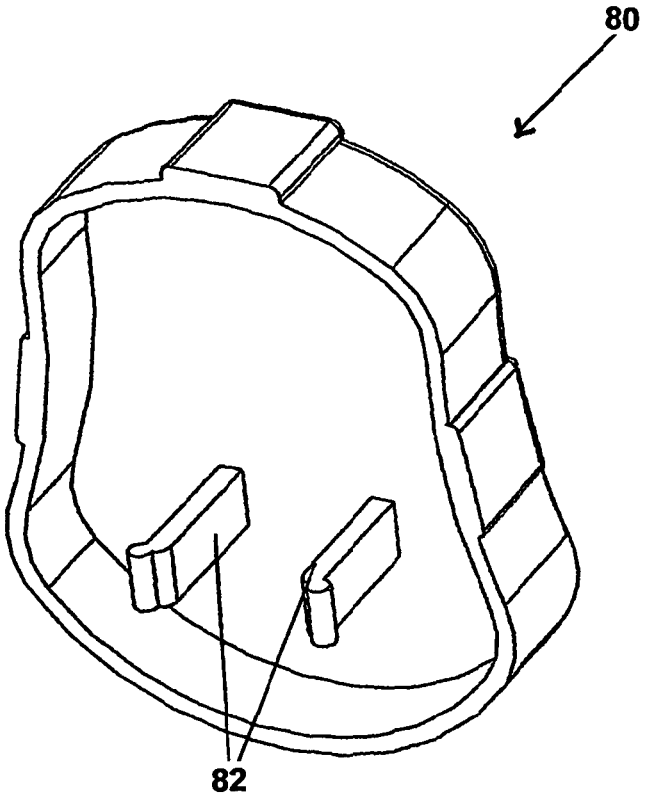
Figure 8:
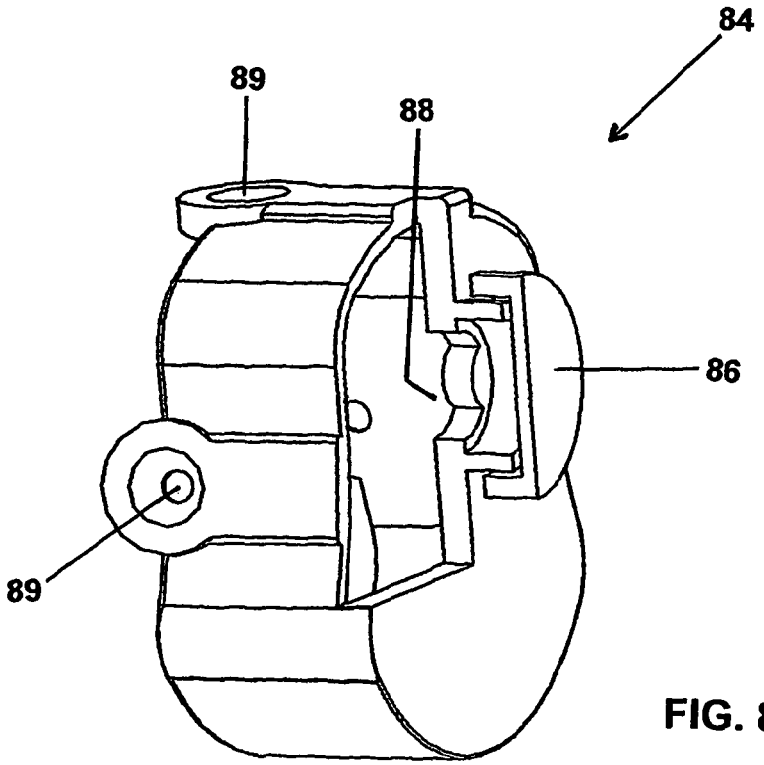
Figure 9:
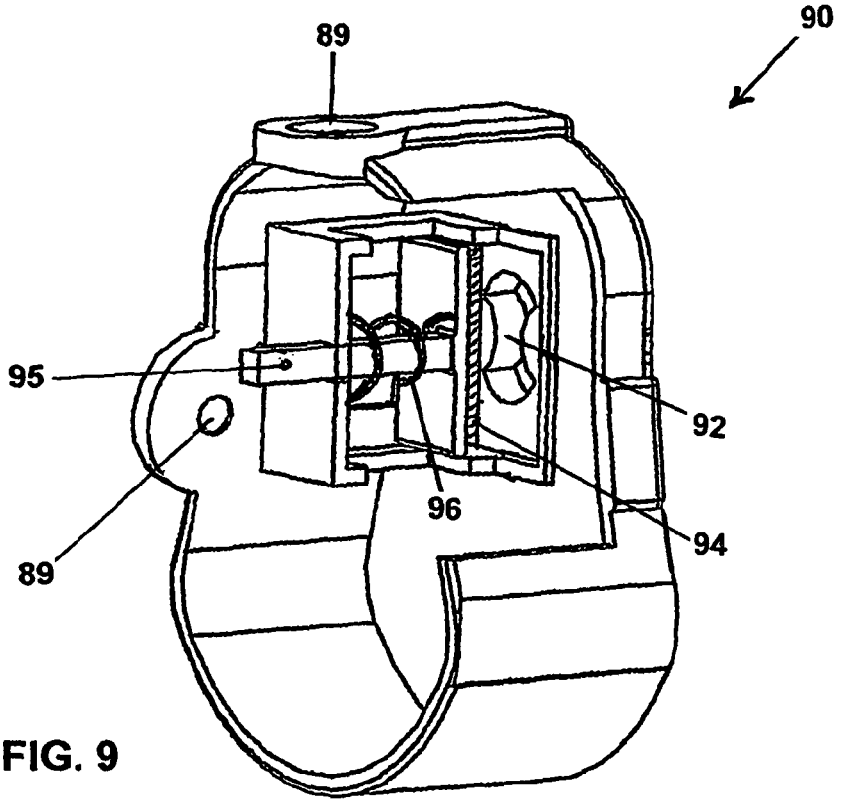
Figure 10:
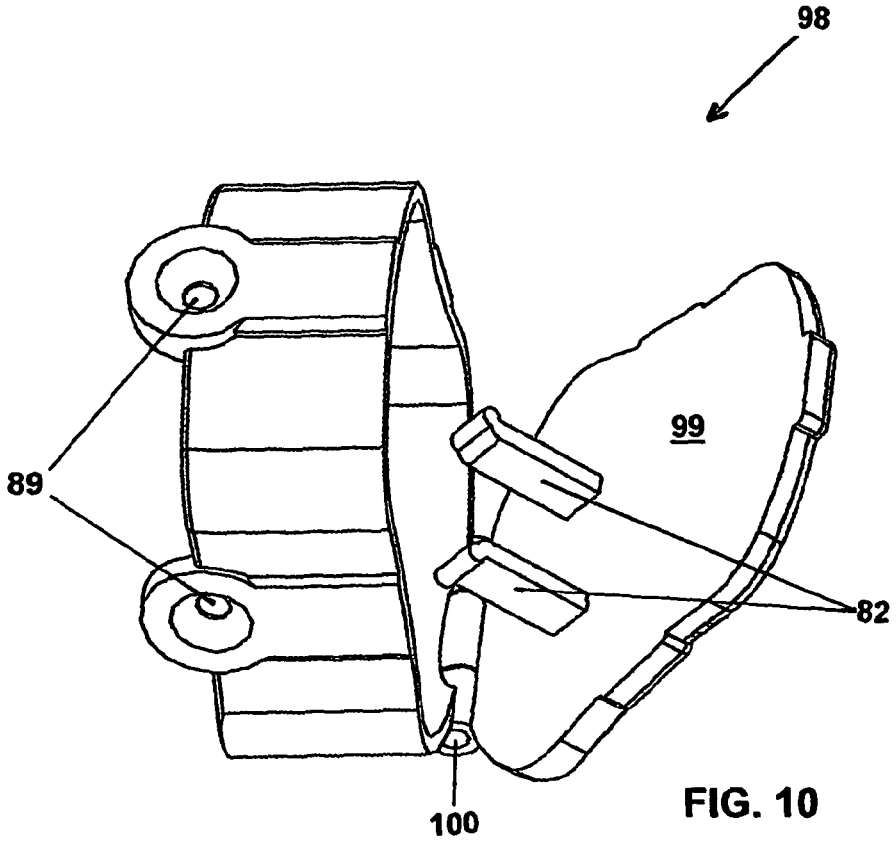
Figure 11:
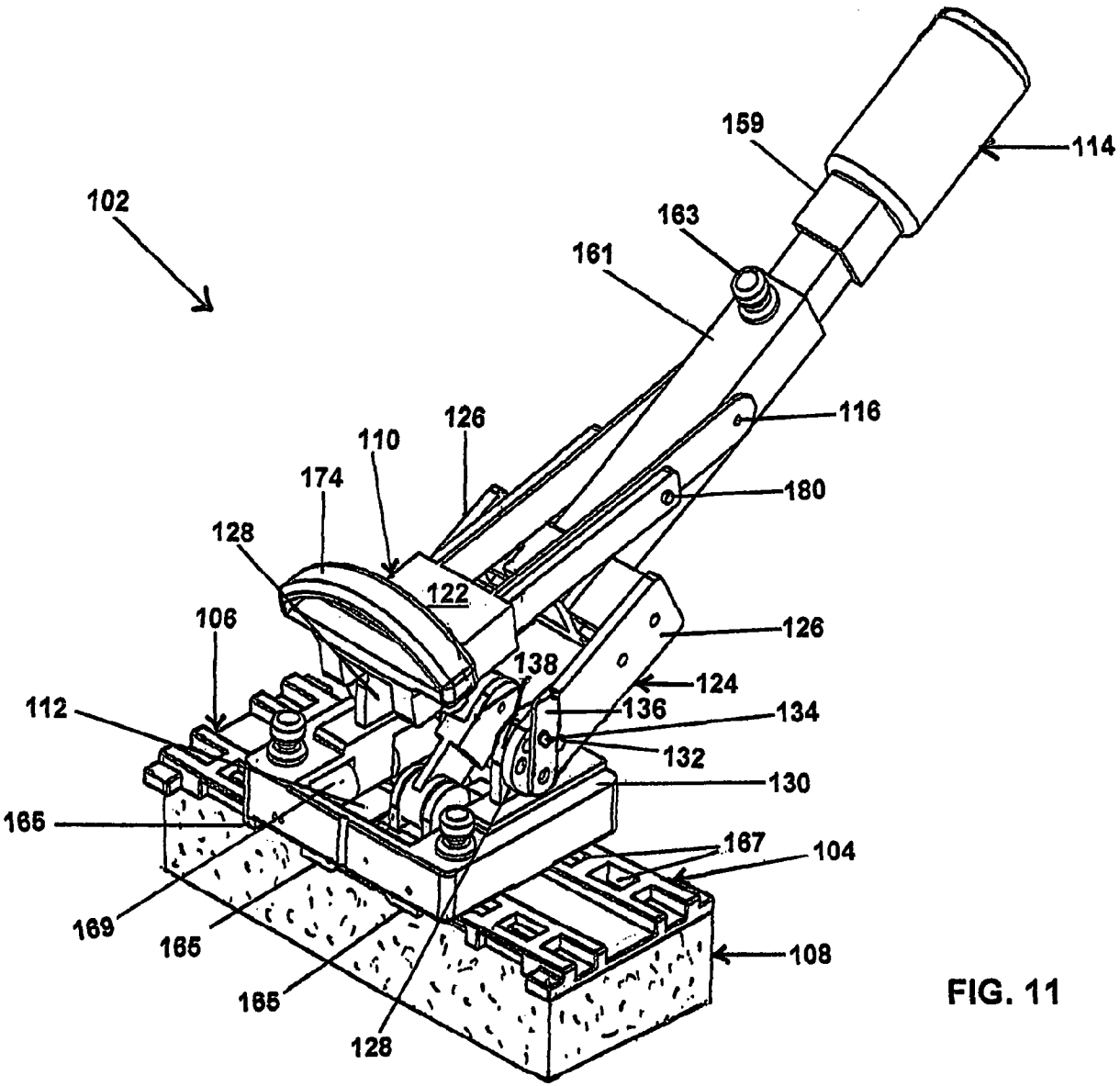
Figure 12:
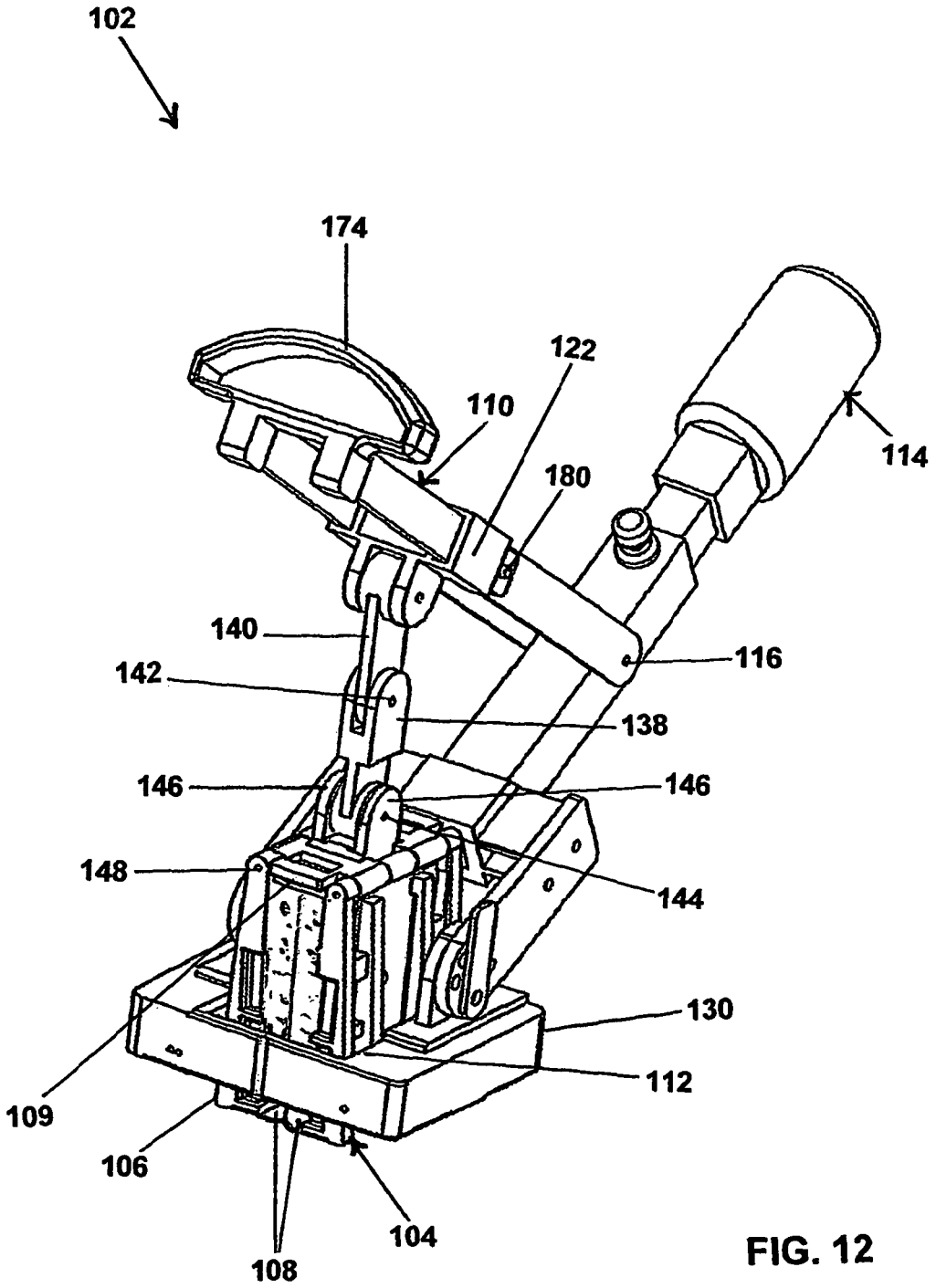
Figure 13:
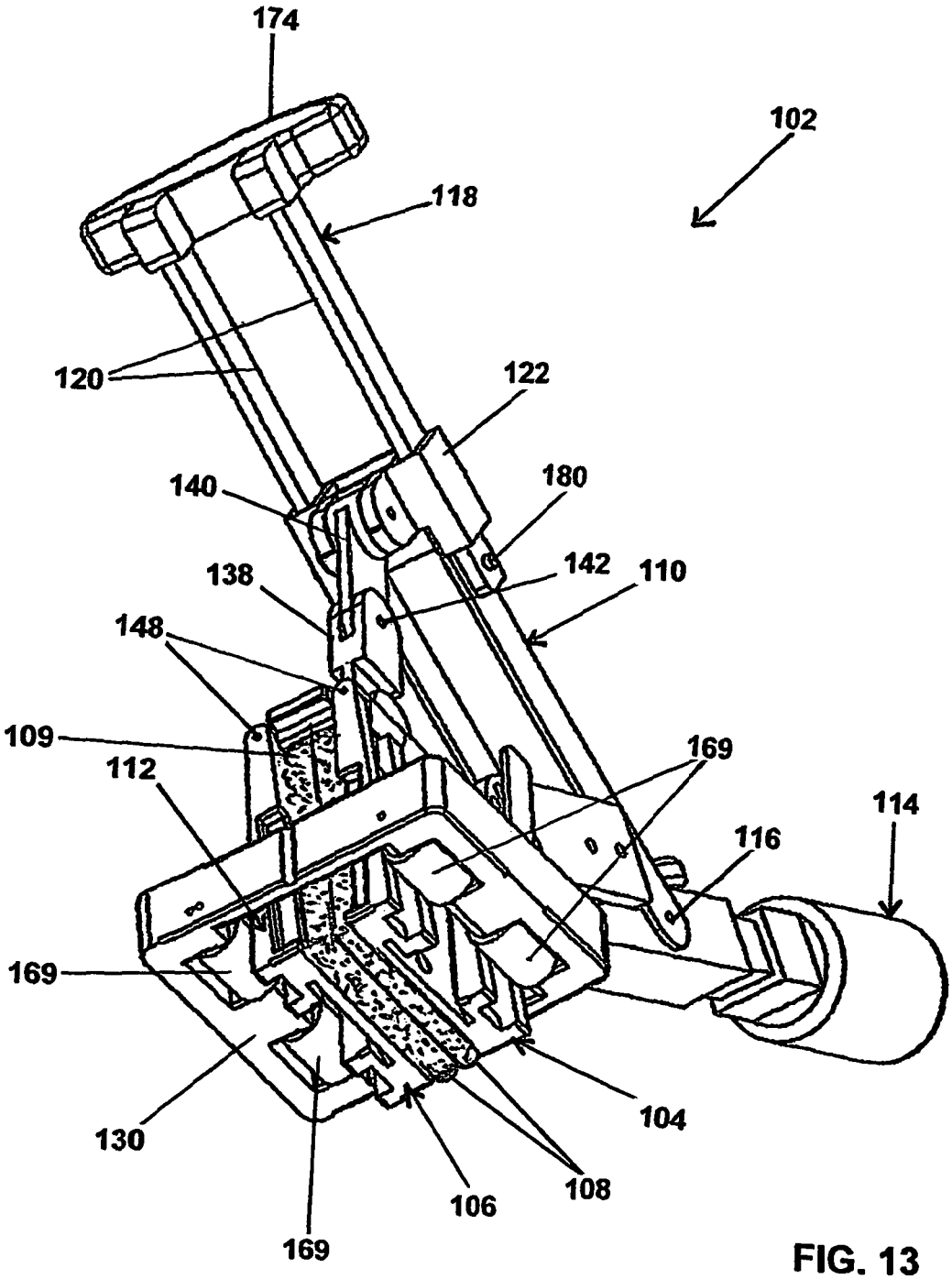
Figure 14:
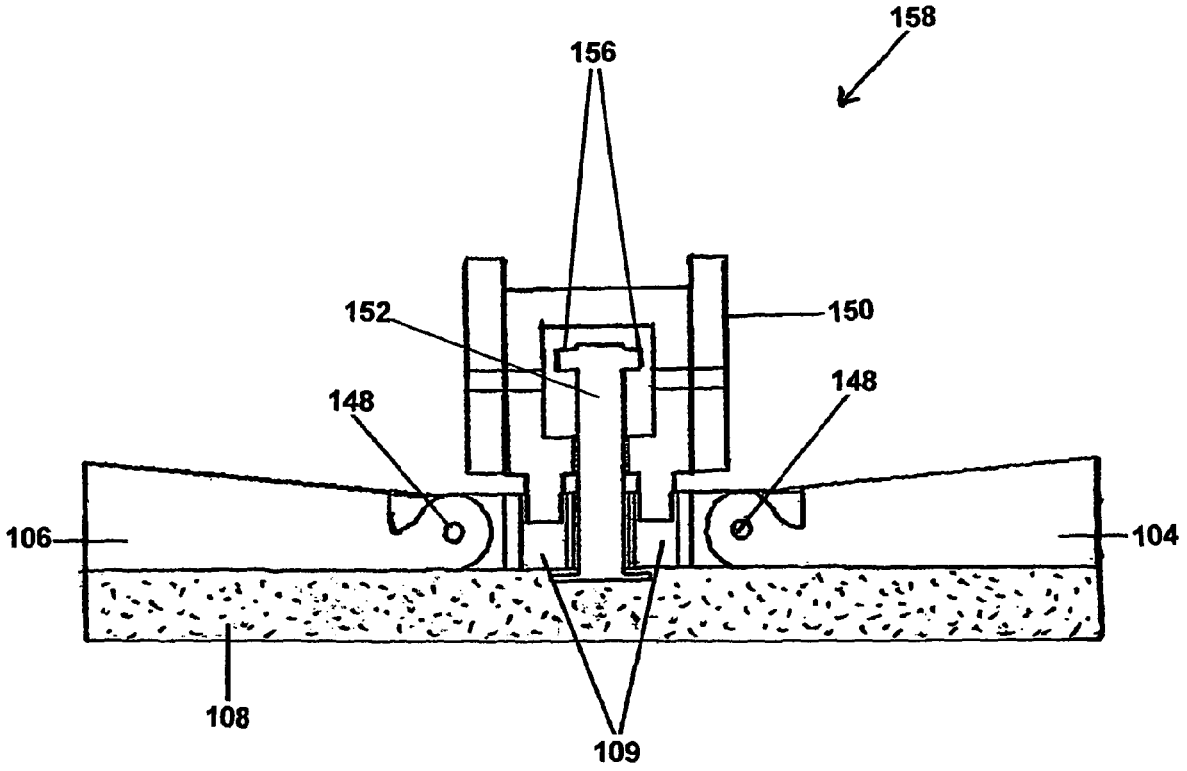
Figure 15:
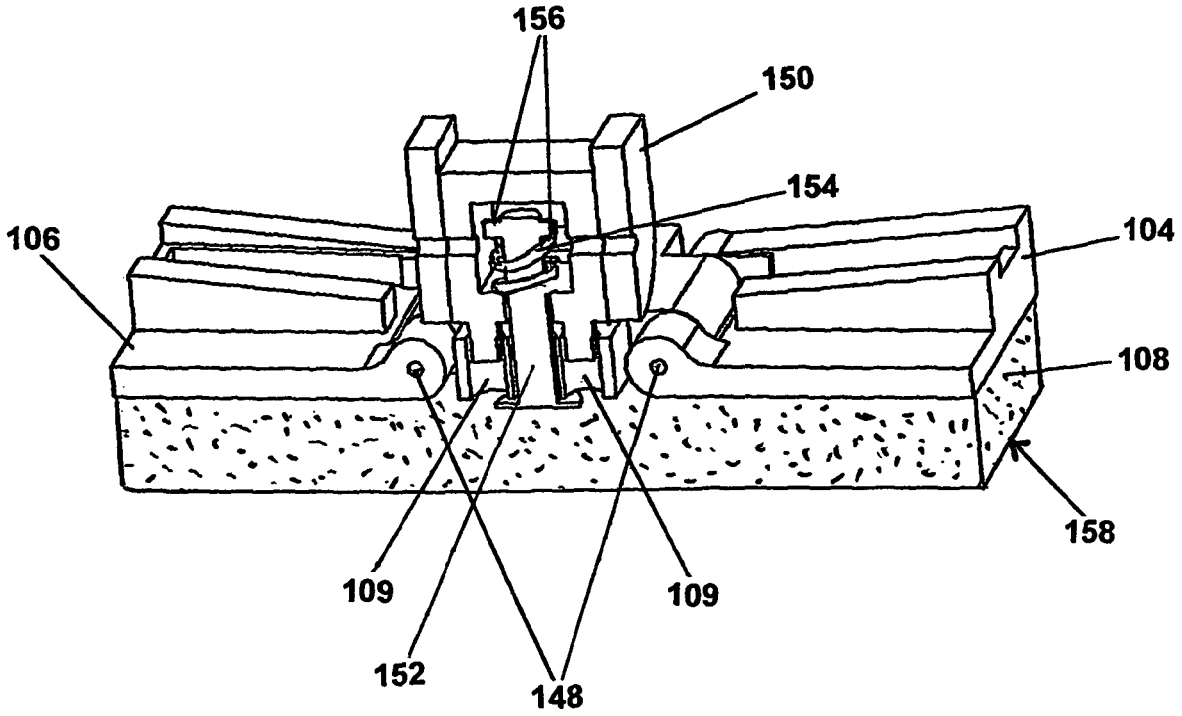
Figure 17:
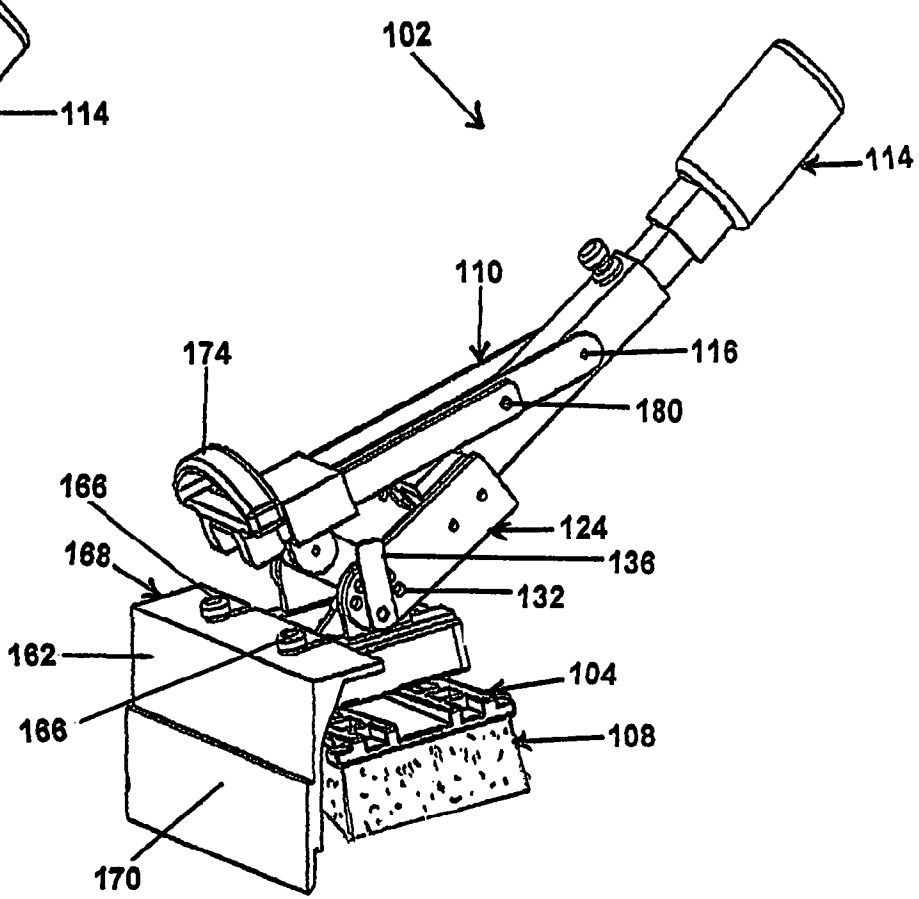
Figure 16:
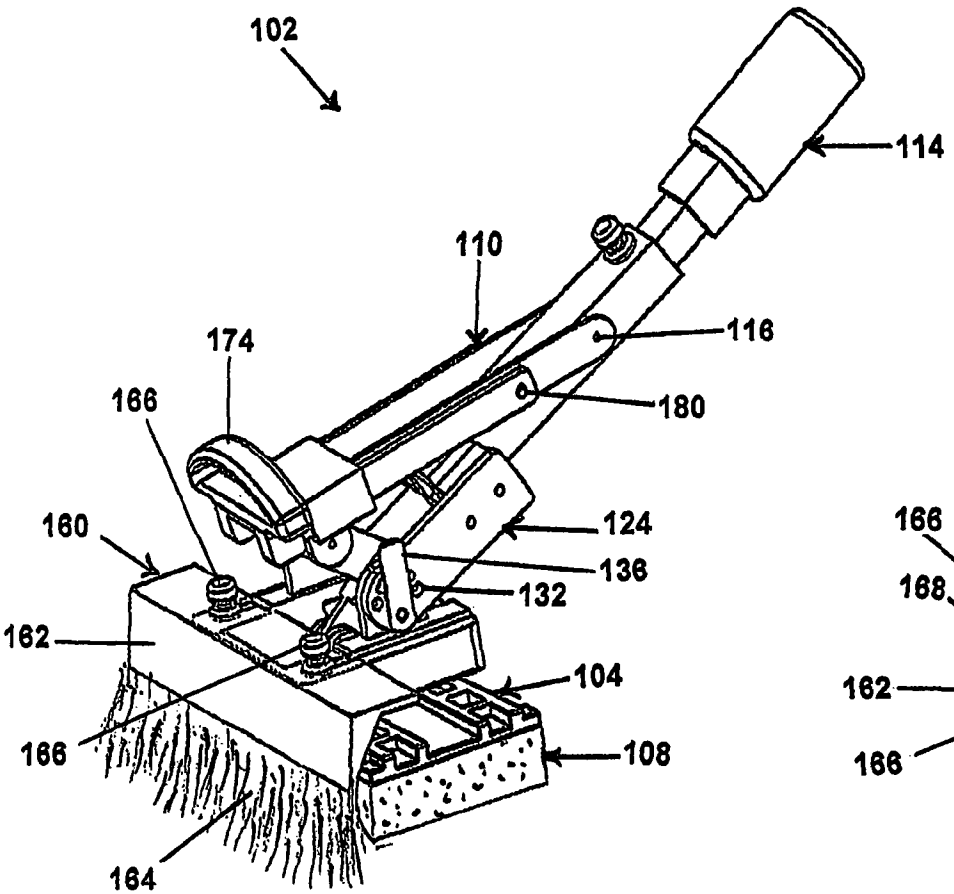
Figure 18:
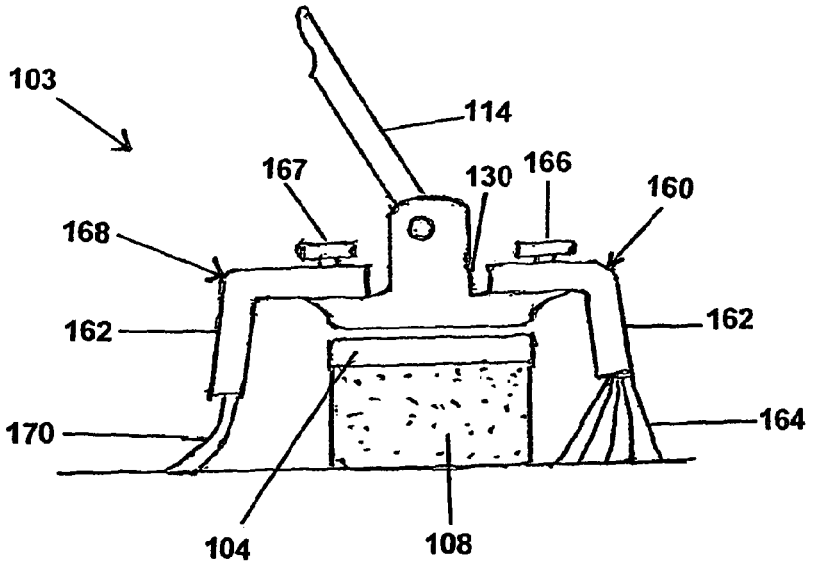
Figure 19:
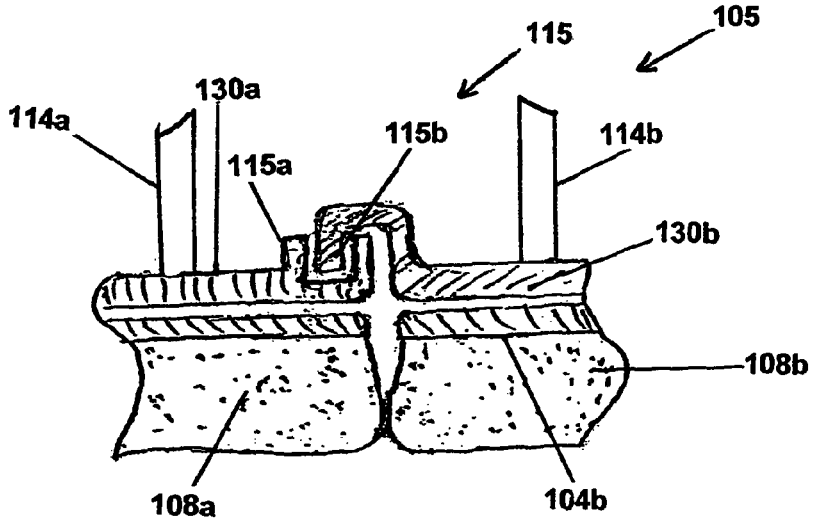

FIG. 4*d* is a section through an alternative replaceable cleaning pad;

FIG. 4*e* is a section through an alternative replaceable cleaning pad;

FIG. 5 is a section through the device shown in FIG. 1;

FIG. 6 is a longitudinal section through a cassette;

FIG. 7 shows the inside of an end cap that may be used on the elongate handle part of the device shown in FIG. 5;

FIG. 8 is a partial cut-away view of an alternative cap to that shown in FIG. 7;

FIG. 9 is a partial cut-away view of a further alternative cap to that shown in FIG. 7;

FIG. 10 shows a further alternative cap to that shown in FIG. 7, and for use with a cassette;

FIG. 11 is a perspective view of a second cleaning device of the present invention and in a use mode;

FIG. 12 shows the device of FIG. 11 but having its cleaning pad being squeezed to remove liquid in the cleaning pad;

FIG. 13 is a view from underneath of the device in the liquid-removing condition shown in FIG. 12;

FIG. 14 is a simplified sectional side view illustrating how the cleaning pad and first and second support members of the cleaning device shown in FIG. 11 pivot;

FIG. 15 is a perspective view of the part of the cleaning device shown in FIG. 14;

FIG. 16 shows a third cleaning device of the present invention;

FIG. 17 shows a fourth cleaning device of the present invention;

FIG. 18 shows a fifth cleaning device of the present invention;

FIG. 19 shows two cleaning devices coupled together; and

Figure 20:
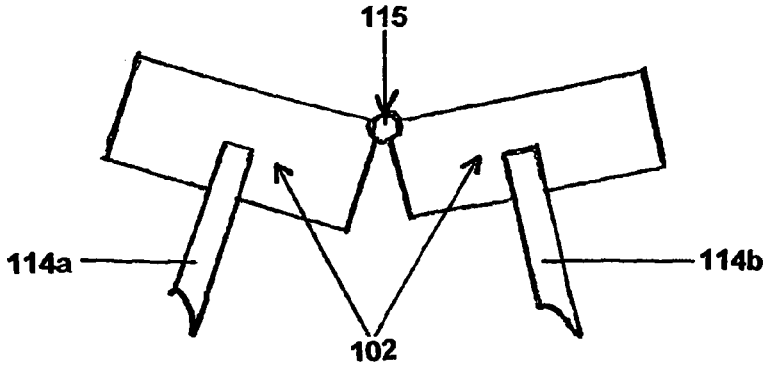

FIG. 20 is an aerial view of part of the two cleaning devices as shown in FIG. 19.

Referring to FIG. 1, there is shown a hand held cleaning device 2 comprising a handle 4 by which the device 2 is held in a person's hand. The device 2 also comprises a first support member 6 and a second support member 8. The device 2 further comprises a cleaning pad 10. The cleaning pad 10 is supported by the first and second support members 6, 8. The cleaning pad 10 is made of a liquid-absorbing material.

The device 2 is such that the first and second support members 6, 8 are pivotable towards each other to squeeze the cleaning pad 10 and thereby remove liquid from the cleaning pad 10. The cleaning pad 10 is rectangular, which enables corner surfaces easily and thoroughly to be cleaned. The cleaning pad 10 is also preferably of a width which enables the cleaning pad 10 to be inserted into containers such for example as cups, mugs and glasses, and to clean the entire inner surface of the containers. The cleaning pad 10 is made of a sponge material.

The cleaning pad 10 is provided with an auxiliary cleaning portion 12. The auxiliary cleaning portion 12 comprises a layer 14 which is mounted on a layer 16. The layer 16 is preferably of the same material as the remainder of the cleaning pad 10. The layer 14 is made of a material which is more abrasive than the material of the remainder of the cleaning pad 10. This more abrasive material enables ingrained dirt more easily to be removed from surfaces requiring more than just simple wiping to be cleaned.

As will be appreciated from FIGS. 1 and 4, the cleaning pad 10 is a replaceable cleaning pad 10. More specifically, the cleaning pad 10 has transversely extending members 18 which have upstanding clips 20. The clips 20 locate and clip into holes 22 formed in the first and second support members 6, 8. When the cleaning pad 10 becomes worn, the clips 20 can easily be removed from the holes 22 to detach the cleaning pad 10 from the device 2 and to enable a new cleaning pad 10 to be clipped into position.

Figure 2:
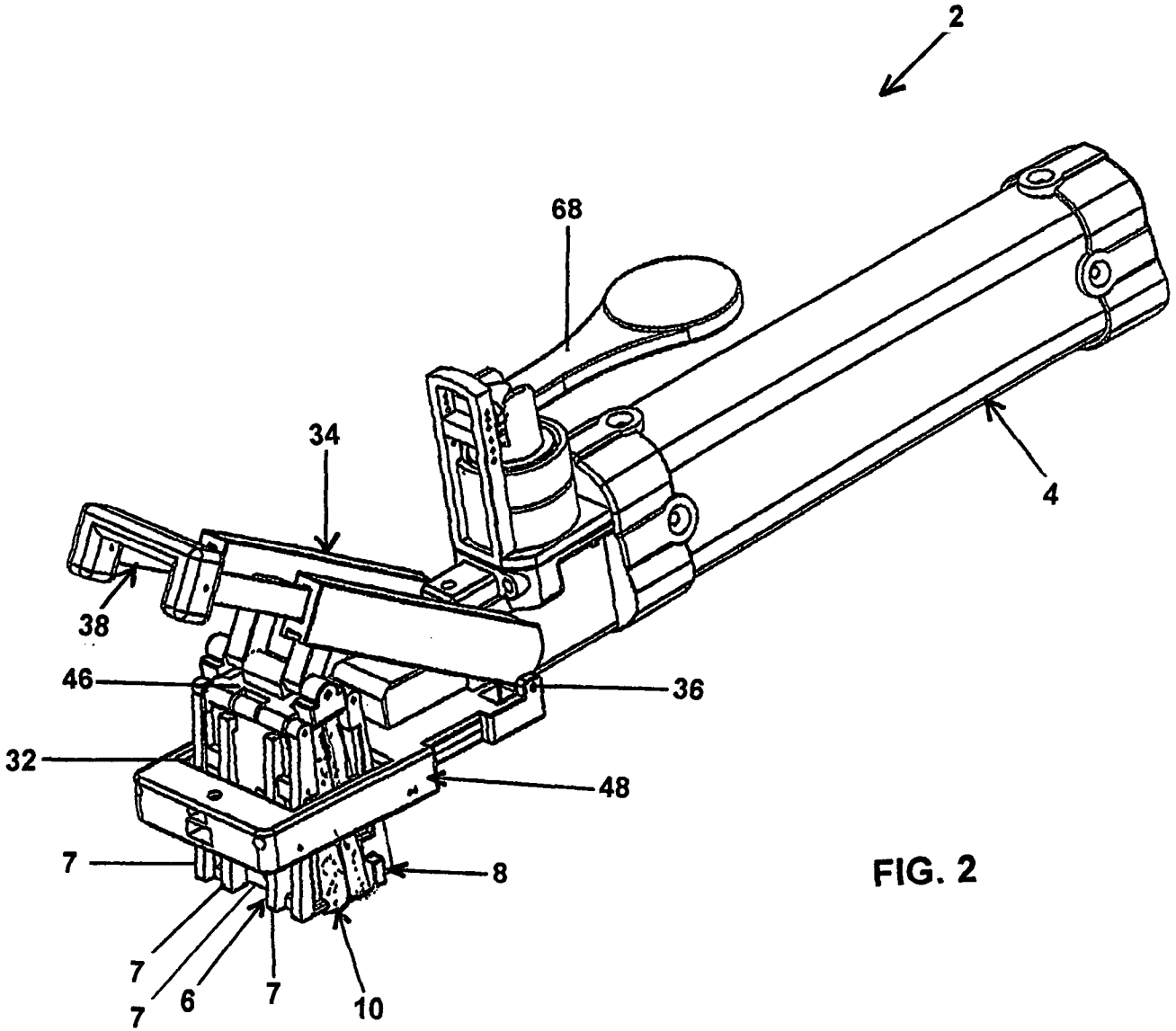
FIG. 2 shows how the device of FIG. 1 operates to squeeze a cleaning pad.
Figure 3:
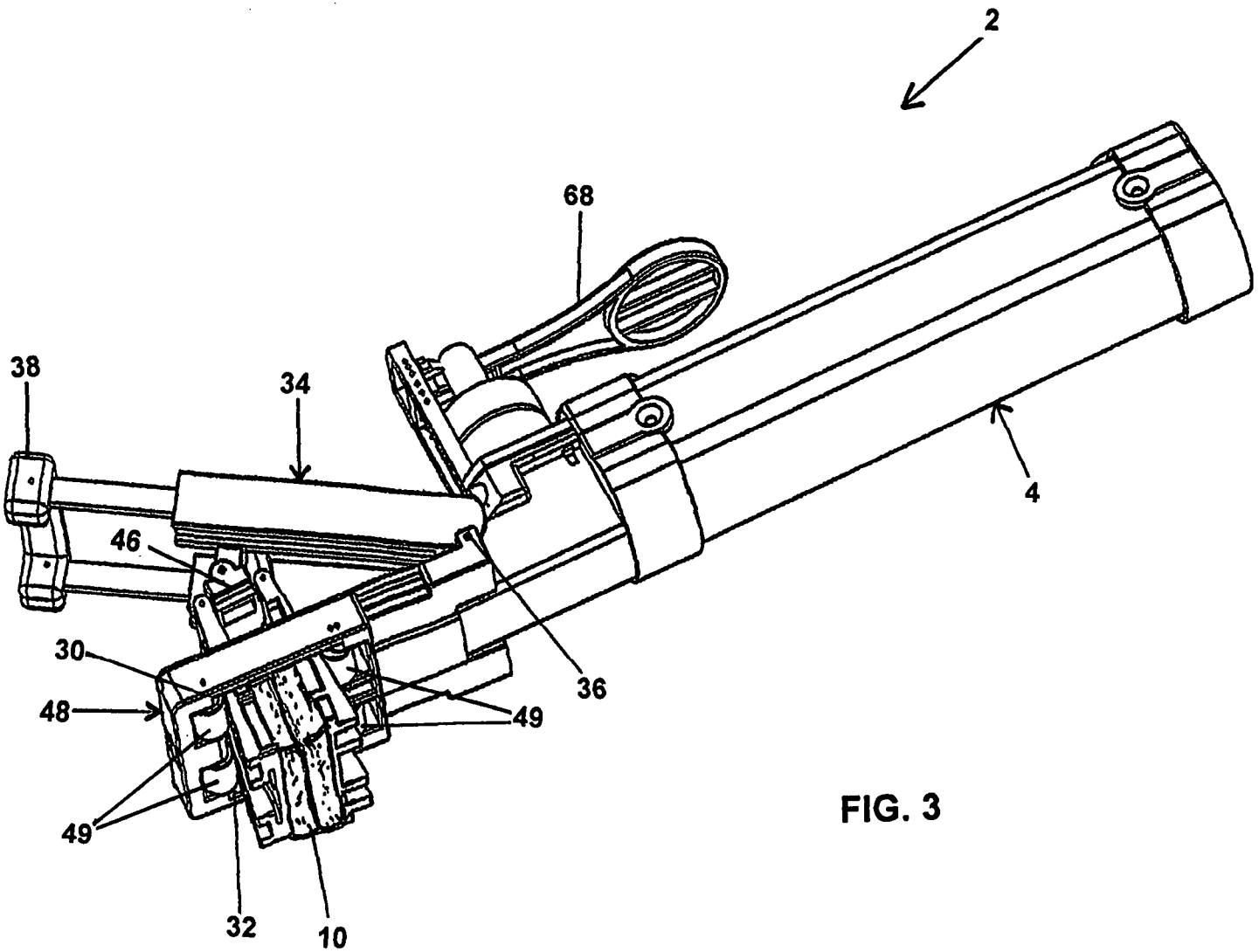
FIG. 3 is a view from underneath and illustrates the squeezing action shown in FIG. 2.

FIGS. 2 and 3 show how the first and second support members 6, 8 are pivotable towards each other by being pulled through an aperture 32 in the device 2.

As can be appreciated from FIGS. 1, 2 and 3, the first and second support members 6, 8 are mounted on a lever mechanism 34. The lever mechanism 34 pivots at one end about pivot 36 to allow the first and second support members 6, 8 to be pulled through the aperture 32. The pulling of the first and second support members 6, 8 into the drying aperture 32 causes sides of the drying aperture 32 to exert a pressure on the first and second support members 6, 8 such that the first and second support members 6, 8 squeeze the cleaning pad 10 so that liquid is able to be removed from the cleaning pad 10.

As shown in FIGS. 2 and 3, the lever mechanism 34 has an extendable portion 38 which increases the length of the lever mechanism 34 when the extendable portion, 38 is pulled out from the retracted position shown in FIG. 1 to the extended position shown in FIGS. 2 and 3. The extendable portion 38 increases the length of the lever mechanism and thereby makes it easier to pivot the lever mechanism 34 away from the aperture 32 and to pull the first and second support member 6, 8 through the aperture 32.

The first and second support members 6, 8 are pivotally mounted to a central member 46. The central member 46 is provided with two of the holes 22 for receiving two of the clips 20. The handle 4 is mounted on a frame portion 48 which includes the aperture 32.

FIGS. 1, 2 and 3 show how the handle 4 extends from one side of the device 2. The handle 4 may be a fixed length elongate handle 4, or it may be a telescopic handle 4. The handle 4 is of a short length when it is of a fixed length. The handle 4 is longer when it is telescopic and un-extended or extended. The handle 4 is thus constructed for enabling the cleaning device 2 to be held in one hand during normal use.

FIG. 3 shows how rollers 49 are employed to assist the passage of the cleaning pad 10 through the aperture 30.

FIG. 4 shows in more detail the cleaning pad 10. In an alternative embodiment (not shown) the auxiliary cleaning portion 12 may be made up of just one layer rather than two layers 14, 16 as in the cleaning pad 10.

FIG. 4*a* shows a cleaning pad like the cleaning pad 10 but with alternative sponge material 10*a*. The sponge material 10*a* shown in FIG. 4*a* is provided with apertures 66.

FIG. 4*b* shows a polishing cover 50*b* which is made of natural fabric for example cotton, or synthetic material for example microfibre.

The inner face 51 of the polishing cover 50*b* is lined with a moisture proof membrane, for example polythene sheeting, so that moisture from the cleaning pad 10 is not transferred to the polishing cover 50*b*.

The polishing cover 50*b* can be attached by slipping over the cleaning pad 10 and support members 6 and 8 and held in position by securing means such as elasticated straps 53 and an elasticated rim 55. Velcro (Registered Trade Mark) or other means can alternatively be used to position the cleaning cover 50*b* over the cleaning pad 10.

FIGS. 4*c* is a section through the cleaning pad shown in FIG. 4*a*. It will be seen that the apertures 66 extend completely through the sponge material 10*a*. FIG. 4*d* is like the cleaning pad shown in FIG. 4*c*, except that the apertures extend inwardly from the lower surface of the sponge material 10*a* and they terminate short of the top surface of the sponge material 10*a*. FIG. 4*e* is like the cleaning pad shown in FIG. 4*c* except that the apertures 56 extend from the top surface of the sponge material 10*b* and terminate before the lower surface of the sponge material 10*b*. Thus in both the constructions shown in FIGS. 4*d* and 4*e*, the apertures do not extend completely through the sponge material.

The various types of apertures 66 are advantageously able to provide the following features.

- up to 40% less material, energy and chemicals to make the sponge.
- less energy for transportation for sponge.
- up to 40% less $CO_2$ emissions in manufacturing and transporting the sponge, thereby giving a smaller carbon footprint.
- less material for land fill at the end of life of the sponge.
- quicker environmental breakdown may be employed by enabling elements and bacteria to get the inside of the sponge via the apertures 66.

FIG. 5 is a longitudinal section of the cleaning device 2 and shows how the elongate handle 4 of the device 2 is hollow with a reservoir 54 for receiving a cleaning liquid. FIG. 5 also shows how the device 2 has an inlet chamber 56 and an outlet chamber 58 with a valve. FIG. 5 further shows a piston 60, a sealing ring 62 and a spring 64. The inlet chamber 56, the outlet chamber 58, the piston 60, the sealing ring 62 and the spring 64 form part of dispensing means for dispensing cleaning liquid from the reservoir 54 to the cleaning pad 10. The dispensing means thus forms a hand-operated pump 66 which includes a pump leaver 68 and the piston 60, the sealing ring 62 and the spring 64. The pump 66 pumps the cleaning liquid to the cleaning pad 10 along a conduit 35 which is looped and which is pulled straight when the handle is extended. FIG. 2 shows that wedges 7 may be employed on the longitudinal sides of the first and second support members 6, 8 to increase the squeezing pressure on the cleaning pad.

FIG. 5 also shows a housing 67 in the handle 4 for a sliding member required for telescoping the handle 4.

FIG. 6 shows a cassette 70 which comprises an outer portion 72 and an inner portion 74. The cassette 70 has a gripping portion 76 which facilitates the insertion and removal of the cassette 70 into the hollow handle 4. FIG. 6 also shows a sealing aperture 78 in the cassette 70. Prior to insertion of the cassette 70 into the handle 4, the aperture 78 is closed. On insertion of the cassette 70 into the handle 4, a membrane or other layer closing the aperture 70 is arranged automatically to be pierced, for example by a hollow needle or other spike device (not shown) which attached to and leads into the inlet chamber 56 of the pump 66. Cleaning liquid can then pass from the reservoir 54 to the pump 66 and out along the conduit 35.

FIG. 7 shows an end cap 80. The cap 80 has clips 82 for enabling the end cap 80 to push on or pull off the remainder of the hand-held cleaning device to which it is fitted. The end cap 80 holds the cassette 70 in the handle 4.

FIG. 8 shows an alternative end cap 84 which may be a push on end cap 84 as shown or which may alternatively be a screw-on end cap. The end cap 84 has a closure cap 86. The closure cap 86 may be a screw-on cap or a push fit cap. The closure cap 86 may be made of a plastics material or a rubber material. The end cap 84 has a filling aperture 88 which is exposed when the closure cap 86 is removed. The end cap 84 has holes 89 for receiving securing means, for example screws, for securing the end cap 84 in position on the handle 4.

FIG. 9 shows a further end cap 90 which may be regarded as a more advanced version of the end cap 84. The end cap 90 has a filling aperture 92, a sealing gasket 94, a spring 96, and a sliding spindle 95.

FIG. 10 shows a further end cap 98 with a lid 99 which pivots about a hinge 100. The pivoting lid 99 may facilitate the insertion of the cassette 70 into the handle 4. Clips 82 secure the lid 99 when closed.

Referring to FIG. 11-15, there is shown a cleaning device 102 comprising a first support member 104, a second support member 106, and a cleaning pad 108. The cleaning pad 108 is supported by the first and second support members 104, 106. The cleaning pad 108 is made of a liquid-absorbing material.

The cleaning device 102 further comprises a lever mechanism 110 for the first and second support members 104, 106. The cleaning device 102 further comprises a drying aperture 112 and a handle 114.

As can best be appreciated from FIGS. 12 and 13, the cleaning device 2 is such that the first and second support members 104, 106 are pivotable towards each other. Pulling on the lever mechanism 110 causes the first and second support members 104, 106 to pivot towards each other and be pulled through the drying aperture 112 in the cleaning device.

The handle 114 is of a length which enables a user in an upright position to clean floor surfaces. With a handle of such a length, the cleaning device 102 can also be used for cleaning other surfaces such for example as the surfaces of walls or ceilings. The handle 114 extends transversely to a longitudinal axis of the cleaning pad 108.

As can be appreciated from a comparison of FIGS. 11 and 12, the lever mechanism 110 pivots about the handle 114. Pivoting is effected about pivots 116.

As can best be appreciated from FIG. 13, the lever mechanism 110 has an extendable portion 118 in the form of two arms 120 which slide through a guide member 122 as shown. The extendable portion 118 is able to be extended in order to increase the length of the lever mechanism 110 and thereby make it easier to pivot the lever mechanism 110 about the pivots 116 and pull the first and second support members 104, 106 through the drying aperture 112.

As can best be appreciated from FIGS. 12 and 13, the drying aperture 112 is a rectilinear drying aperture 112. More specifically, the rectilinear drying aperture 112 is rectangular but can be square if preferred.

The handle 114 is pivotable such that it is able to extend at different angles with respect to the cleaning pad 108. This pivoting function of the handle 114 is best shown in FIG. 11 where it will be seen that the handle 114 terminates in a frame portion 124. The frame portion 124 has a pair, of arms 126 which are pivotally mounted to upstanding supports 128 which upstand from a frame portion 130. The supports 128 are provided with holes 132. A pin 134 on a lever 136 is able to be inserted in an appropriate hole 132 simply by pulling the lever 136 away from its support 128 and then locating the pin 134 in the required hole 132. The pin 134 extends through the arm 126 and via the hole 132 into the adjacent support 128.

FIGS. 12 and 13 illustrate how the lever mechanism 110 includes a pair of arms 138, 140 which pivot with respect to each other about a pivot 142. The arms 138, 140 extend with respect to each other when the cleaning device 102 is being used with the lever mechanism 110 pulled to pull the first and second support members 104, 106 and the cleaning pad 108 through the drying aperture 112. In the cleaning mode shown in FIG. 11, the arms 138, 140 are able to pivot alongside each other and thus occupy less space than if they were in the form of a single fixed arm. The arm 138 pivots about a pivot 144 in a pair of lugs 146 located in central member 109 as best shown in FIG. 12.

The pivoting action of the first and second support members 104, 106 is illustrated in simplified form in FIGS. 14 and 15. It will be seen that the first and second support members 104, 106 pivot about pivots 148 in central member 109.

FIG. 14 shows the cleaning head part 158 comprising the cleaning pad 108, the support members 106 and 104, and the central member 109.

FIGS. 14 and 15 also illustrate how the cleaning device 102 is able to be provided with a frame portion 150 which enables the handle 114 to be rotatable about the longitudinal axis of the cleaning head part 158. After use and for storage purposes, the handle 114 and the cleaning head part 158 can be relatively rotated from the position shown in FIG. 11 to a position in which the handle extends in line with the longitudinal axis of the cleaning pad 108. The relative rotation of the handle 114 and the cleaning head part 158 is effected with a pull down and rotational movement of the cleaning head part 149, the movement being of the type used with a bayonet fitting. More specifically, an axle 152 is spring-biased by a spring 154. The axle 152 has top portion 156. When the cleaning head part 158 of the cleaning device 102 is pulled downwardly, the cleaning part 158 disengages from locating pins and it is then possible to rotate the cleaning head 158 so that the handle is then in line with the longitudinal axis of the cleaning pad 108.

The handle 114 is a telescopic handle having a part 159 which slides in a part 161. The two parts 159, 161 are secured in a desired position by fixing means in the preferred form of a screw 163.

The cleaning pad 108 is a replaceable cleaning pad which is held in place by clips 165 locating in apertures 167 in the first and second support members 104, 106. Alternative securing means for fixing the replaceable pad 108 in position may be employed so that the alternative fixing means may be, for example, Velcro (Registered Trade Mark).

When the first and second support members 104, 106 and the cleaning pad 108 are folded and pulled through the drying aperture 112 by the lever mechanism 110, the pulling of the parts through the drying aperture 112 is facilitated by rollers 169. The rollers 169 form sides of the drying aperture 112 that exert a squeezing pressure on the first and second support members 104, 106.

Referring to now FIG. 16, the cleaning device 102 of FIG. 11 is shown, and additionally fitted with a brush 160 which comprises a body portion 162 and bristles 164. Preferably, screw bolts 166 secure the body portion 162 to the cleaning device 102 shown in FIG. 11.

Referring now to FIG. 17, there is again shown the cleaning device 102 of FIG. 11, but this time fitted with a squeegee 168. The squeegee 168 comprises the body portion 162 but a rubber or plastics blade 170 instead of the bristles 164. The body portion 162 is again held in position preferably by the screw bolts 166.

Referring now to FIG. 18, there is shown in diagrammatic transverse section, a cleaning device 103 which is like the cleaning device 102 of FIG. 11. In the cleaning device 103, the squeegee 168 is positioned to the rear of the cleaning device 103. The brush 160 is positioned to the front of the cleaning device 103. This arrangement allows (a) simultaneous sweeping of the floor by the bristles, (b) wetting of the floor by the cleaning fluid in the cleaning pad 108, and (c) the drying of the floor by the squeegee blade 170, as the cleaning device 103 is pushed forward using handle 114.

Referring now to FIG. 19, there is shown in diagrammatic longitudinal section a cleaning device 105. The cleaning device 105 is two of the cleaning devices 102 coupled together. The coupling mechanism 115 is composed of a female part **115*a* located on the frame portion 130*a* of the first cleaning device 102. A male part 115*b* is located on frame portion 130***b* of the second cleaning device 102. The male part 115*b* is an axle which fits into and pivots within the female part 115*a*. The female part 115*a* is a cylindrical housing.

Referring now to FIG. 20 there is shown an aerial view of part of the cleaning device 105 shown in FIG. 19. More specifically, FIG. 20 shows how cleaning devices 102 are coupled and are able to pivot relative to each other by operation of handles 114*a* and 114*b*. The coupling arrangement 115 of the cleaning devices 102 enables a wider span of floor area to be cleaned when the cleaning devices are adjacent to each other. The pivoting arrangement enables the cleaning devices 102 to be pushed apart at an angle, so enabling passage through a narrow opening for example as a door or under a bed. The coupling arrangement 115 enables the cleaning devices 102 easily to be separated so that each can be cleaned, and the cleaning pads 108*a* and 108*b* can be recharged with fresh cleaning fluid.

The cleaning devices shown in the drawings are easily able to be operated to squeeze the cleaning pad to remove the liquid, for example water or any other liquid that is desired to be removed from a surface. The cleaning pad is able to be squeezed without a person having actually to contact the cleaning pad with their hands. This avoids the person's hands becoming wet and possibly marked or contaminated by the liquid in the cleaning pad. In addition to cleaning up liquid, the illustrated cleaning devices are able to be used simply for wiping surfaces in order to clean the surfaces. The illustrated cleaning devices are thus easily used versatile cleaning devices which are able to find a use in many different situations in, for example, kitchens, offices, factories, hospitals, nursing homes, schools, hotels, restaurants and contoured surfaces of, for example, vehicles such as cars. When provided with a chamber containing a cleaning liquid, the device is able to form a completely self-contained cleaning station. Any suitable and appropriate cleaning liquid may be employed including water and proprietary cleaning liquids.

It is to be appreciated that the embodiments of the invention described above with reference to the accompanying drawings have been given by way of example only and that modifications may be effected. Also, the illustrated features in the drawings are applicable to all designs of the cleaning device of the present invention. Individual components shown in the drawings are not limited to use in their drawings and they may be used in other drawings and in all aspects of the invention.

The invention claimed is:

1. A cleaning device comprising a first support member, a second support member, a cleaning pad which is supported by the first and second support members and which is made of a liquid-absorbing material, a lever mechanism for the first and second support members, a frame portion, a drying aperture which is in the frame portion and which is defined by four sides of the frame portion, and a handle, and the cleaning device being such that:

(i) the first and second support members are pivotable towards each other;

(ii) pulling on the lever mechanism causes the first and second support members to pivot towards each other and be pulled into the drying aperture in the cleaning device;

(iii) the first and second support members are pulled into the drying aperture in a direction which is offset from a longitudinal axis of the handle; and (iv) the pulling of the first and second support members into the drying aperture causes sides of the drying aperture to exert a pressure on the first and second support members such that the first and second support members squeeze the cleaning pad so that liquid is able to be removed from the cleaning pad.

2. A cleaning device according to claim 1 in which the lever mechanism pivots about the handle, or about a frame portion located between the handle and the first and second support members.

3. A cleaning device according to claim 1 in which the lever mechanism has an extendable portion for increasing the length of the lever mechanism and thereby making it easier to pivot the lever mechanism and pull the first and second support members through the drying aperture.

4. A cleaning device according to claim 1 in which the drying aperture is a rectilinear drying aperture.

5. A cleaning device according to claim 1 in which the handle extends at a fixed angle with respect to the cleaning pad, or in which the handle is pivotable such that it is able to extend at different angles with respect to the cleaning pad.

6. A cleaning device according to claim 1 in which the cleaning pad is made of a sponge material layer and an abrasive cleaning material layer.

7. A cleaning device according to claim 1 in which the cleaning pad includes an auxiliary cleaning portion which is made of a different material to the remainder of the cleaning portion and in which the auxiliary cleaning portion is made of a material which is more abrasive than the material of the cleaning pad of the cleaning device.

8. A cleaning device according to claim 1 in which the cleaning pad is a replaceable cleaning pad.

9. A cleaning device according to claim 1 in which the handle is of a length constructed for enabling the cleaning device to be held in one hand during normal use.

10. A cleaning device according to claim 1 in which the handle is a length constructed for enabling the cleaning device to be held in two hands during normal use.

11. A cleaning device according to claim 1 in which the handle is a fixed length handle, or a telescopic handle.

12. A cleaning device according to claim 1 and including a chamber for receiving a cleaning liquid.

13. A cleaning device according to claim 12 in which the chamber is for receiving a cassette filled with the cleaning liquid.

14. A cleaning device according to claim 12 and including dispensing means for dispensing the cleaning liquid from the chamber to the cleaning pad or surface to be cleaned.

15. A cleaning device according to claim 14 in which the dispensing means includes a hand-operated pump.

* * * * *